United States Patent [19]

Muise

[11] 4,103,819

[45] Aug. 1, 1978

[54] TWO-PIECE CONTAINER

[75] Inventor: Herbert D. Muise, Garden Grove, Calif.

[73] Assignee: Weyerhaeuser Company, Tacoma, Wash.

[21] Appl. No.: 749,850

[22] Filed: Dec. 13, 1976

Related U.S. Application Data

[63] Continuation of Ser. No. 667,047, Mar. 15, 1976, abandoned.

[51] Int. Cl.[2] ..... B65D 5/28; B65D 5/18

[52] U.S. Cl. ..... 229/33; 229/6 A; 229/23 AB; 229/23 R

[58] Field of Search ..... 229/6 A, 23 R, 23 AB, 229/23 A, 33, 34 R, 36

[56] References Cited

U.S. PATENT DOCUMENTS

| | | | |
|---|---|---|---|
| 2,232,632 | 2/1941 | Reynolds | 229/6 A |
| 2,412,402 | 12/1946 | Huye | 229/6 A |
| 2,540,595 | 2/1951 | Pnops | 229/23 R |
| 2,757,851 | 8/1956 | Moore | 229/23 AB |
| 2,758,775 | 8/1956 | Moore | 229/23 AB |
| 2,801,742 | 8/1957 | Farrell | 229/6 A X |
| 3,157,346 | 11/1964 | Hamilton | 229/23 AB |
| 3,335,934 | 8/1967 | Davis | 229/23 R |
| 3,428,234 | 2/1969 | DuBarry, Jr. | 229/23 R |
| 3,430,839 | 3/1969 | McColl | 229/23 R |
| 3,434,648 | 3/1969 | DuBarry, Jr. | 229/23 R |
| 3,692,231 | 9/1972 | Neitzke | 229/45 |
| 3,899,121 | 8/1975 | Herbetko | 229/34 R |
| 3,952,672 | 4/1976 | Gordon et al. | 229/23 AB |

*Primary Examiner*—Davis T. Moorhead

[57] ABSTRACT

A container formed by a tray within a second tray. This construction has good stacking strength because of the doubled side walls to prevent crushing of the product when stacked. The bottom of the container also has additional strength and does not sag. The double thickness end walls also provide insulation of the product so that produce stacked in the containers in the field do not become sunscorched or burned. The container also has indented side walls and an indented cover which allows air passage and cooling within the container even though the containers are stacked tightly together. Certain configurations have a manual cover locking feature which allows assembly enclosure in the field.

16 Claims, 11 Drawing Figures

Fig. 6
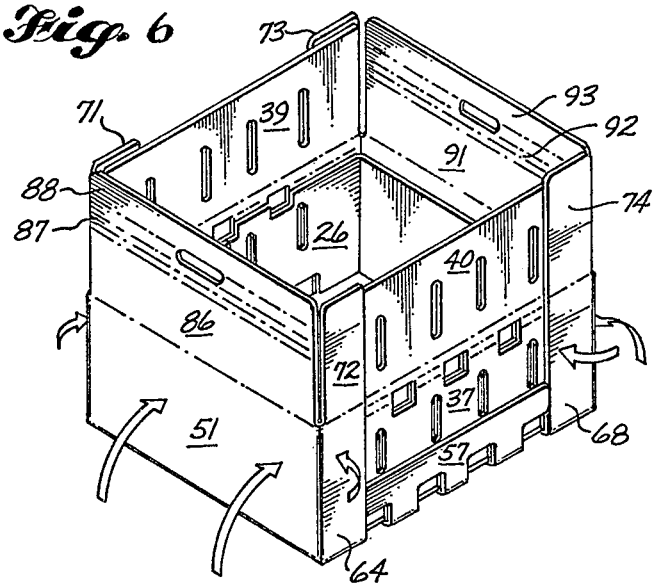
Fig. 7
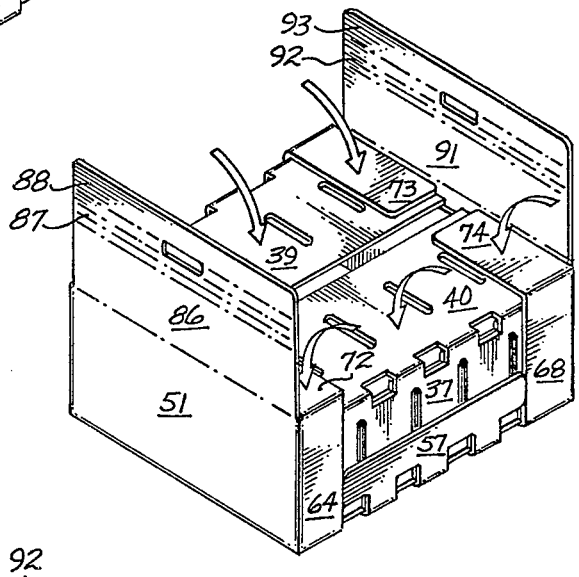
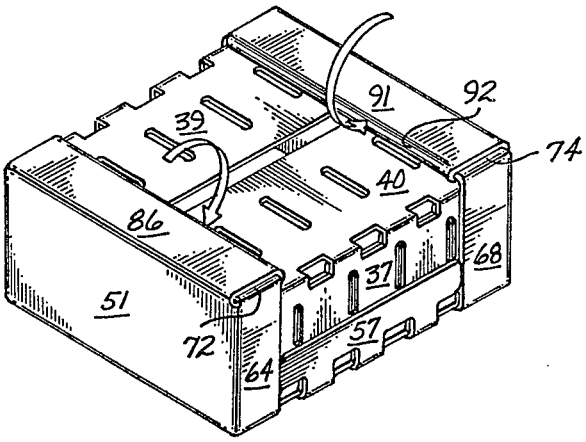
Fig. 8

TWO-PIECE CONTAINER

RELATED APPLICATION

This is a continuation of U.S. Pat. application Ser. No. 667,047 filed Mar. 15, 1976, now abandoned.

BACKGROUND OF THE INVENTION

1. Field of the Invention

A container formed by a pair of trays, one inside the other.

2. Description of the Prior Art

Containers of the type shown in U.S. Pat. Nos. 3,428,234, 3,434,648, and 3,692,231 are known. It is also known to place holes or slots in the side walls 7 and 8 and along the score lines 4, 5, 11 and 12 of the container shown in U.S. Pat. No. 3,434,648. It is also known to place an interior tube around the side and end walls of the container which is that shown in U.S. Pat. No. 3,434,648 to provide additional strength in the container.

BRIEF SUMMARY OF THE INVENTION

A container is formed from two trays, one inside the other. The side, end and bottom walls of the outer container are adhered to the inner container. The side walls of the outer container have Bliss-style flaps which are adhered to the side walls of the inner container and provide an indented section on the side wall. The upper cover sections are locked in place by a pair of flaps which extend over the cover panels. These flaps may either be glued to the upper cover panels or be of a tuck-lock construction which may be formed without machinery. This provides an indented cover panel. The indented side wall and cover may have holes to provide air circulation within the box. The indenting allows air circulation even though boxes are packed closely together. The dual wall construction provides stacking strength in the container and also prevents bulging of the bottom wall.

BRIEF DESCRIPTION OF THE DRAWINGS

FIGS. 5–6 are isometric views showing the formation of the outer container around the inner container.

FIGS. 7–8 are isometric views showing the locking of the cover of the container in the field.

DESCRIPTION OF THE PREFERRED EMBODIMENTS

The present container is of corrugated material to provide the necessary strength.

Figure 1:
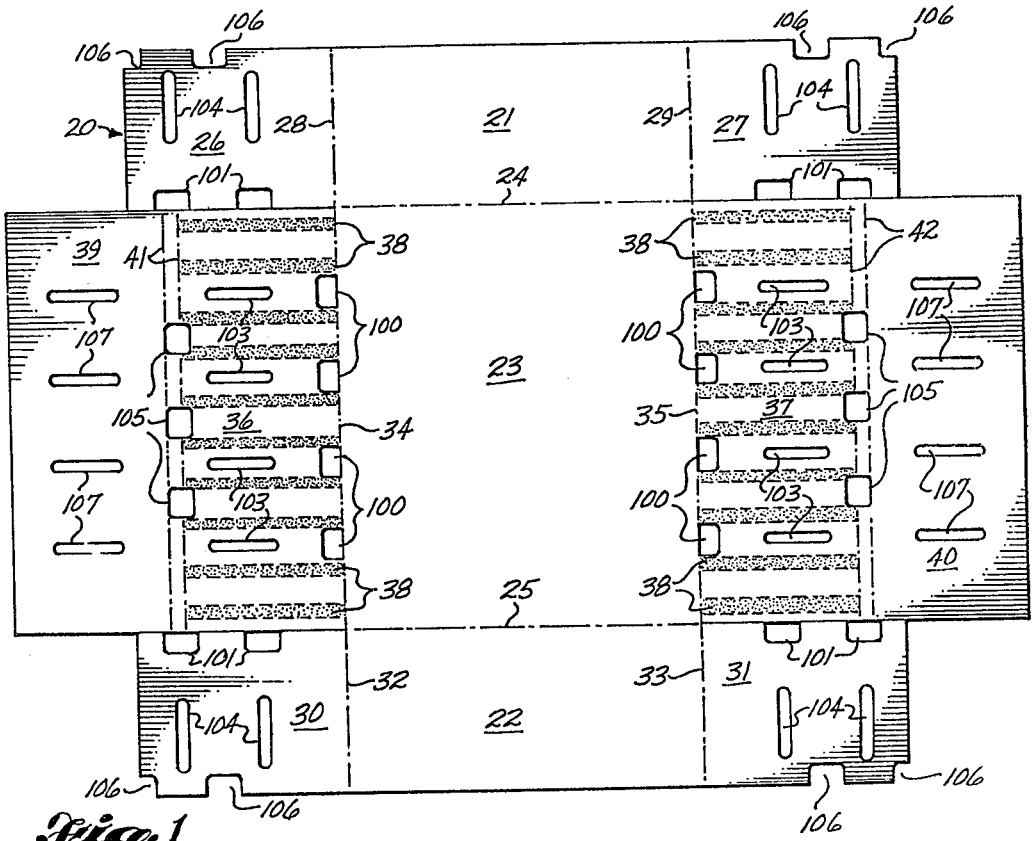
FIG. 1 is a top plan view of a blank for the inner container.
Figure 3:
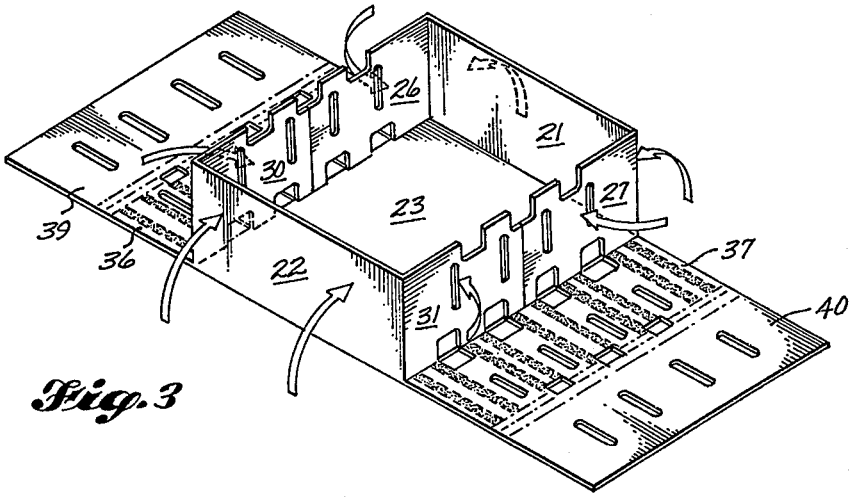
FIGS. 3–4 are isometric views showing the formation of the inner container.
Figure 4:
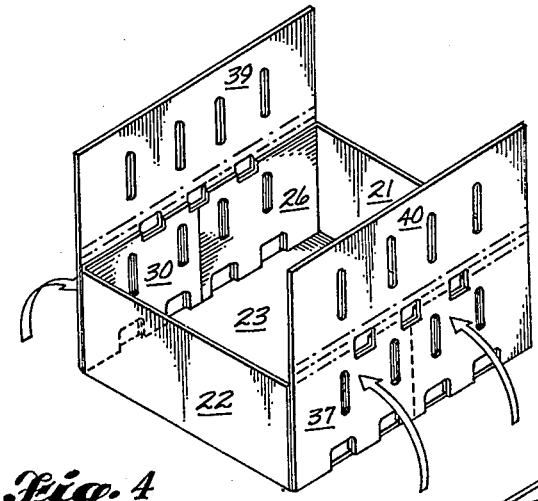

The blank 20 of the inner container 20 is shown in FIG. 1 and its formation is shown in FIGS. 3 and 4. End walls 21 and 22 and inner tray side walls 36 and 37 are attached to bottom wall 23 by score lines 24, 25, 34 and 35, respectively. Side wall panels 26 and 27 are attached to inner tray end wall 21 by score lines 28 and 29 respectively, and side wall panels 30 and 31 are attached to end wall 22 by score lines 32 and 33 respectively. In the formation of the box, end walls 21 and 22 are bent upwardly around score lines 24 and 25 until substantially perpendicular to bottom wall 23. Side wall panels 26, 27, 30 and 31 are bent inwardly around score lines 28, 29, 32 and 33 respectively until the side wall panels 26 and 30 overlie score line 34 and side wall panels 27 and 31 overlie score line 35.

As noted hereinbefore score lines 34 and 35 connect inner tray side walls 36 and 37 respectively to bottom wall 23. The side walls 36 and 37 are then bent upwardly around score lines 34 and 35, respectively, and adhered to the side panels by glue strips 38 on said side walls 36 and 37. Until the container is filled, cover panels 39 and 40 remain upright. These cover panels are connected to side walls 36 and 37 by double score lines 41 and 42, respectively.

Figure 2:
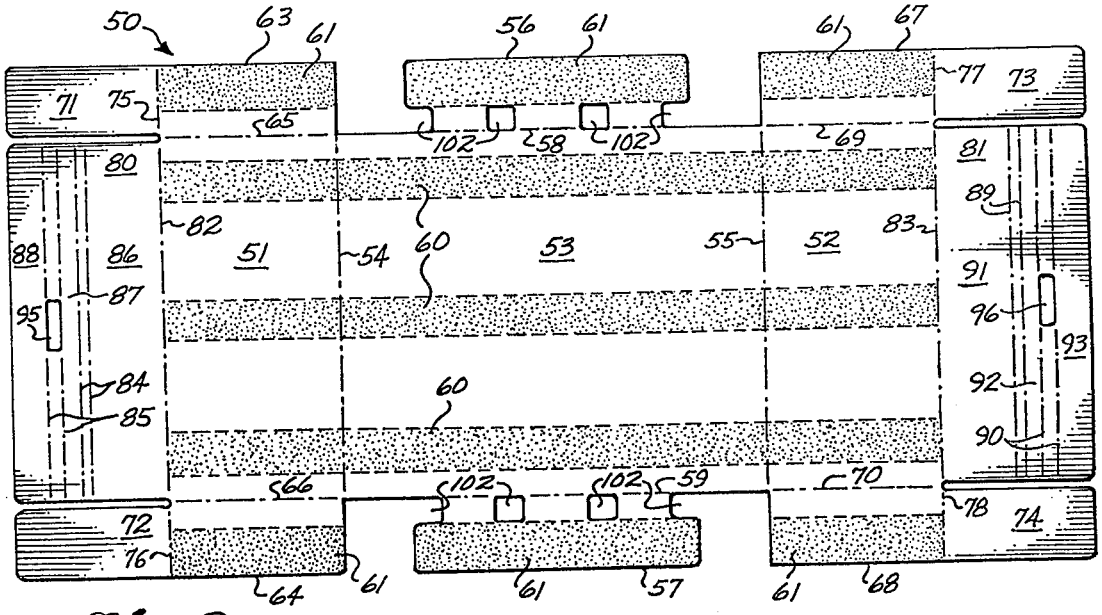
FIG. 2 is a top plan view of a blank for the outer container.
Figure 5:
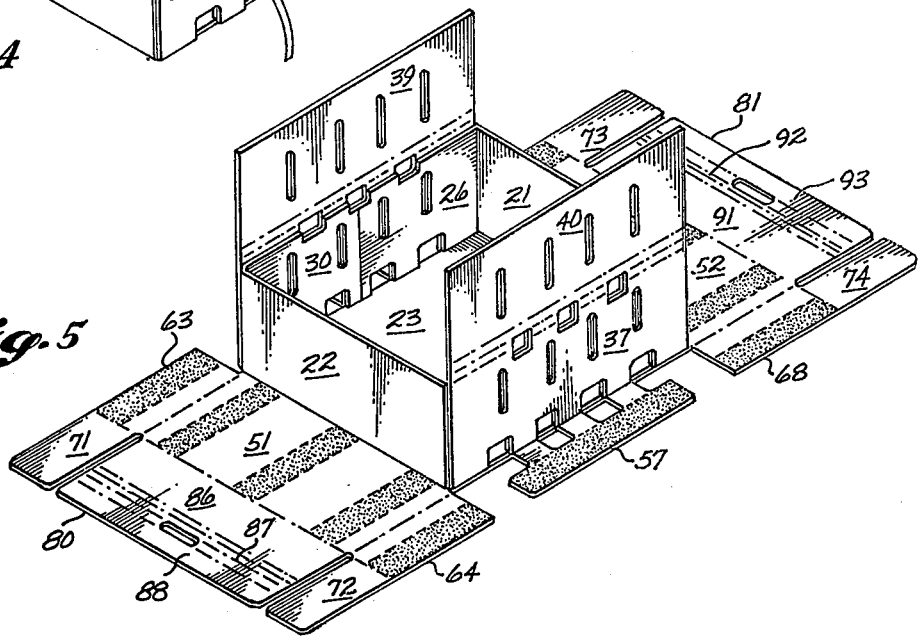

Blank 50 for the outer tray is shown in FIG. 2 and its formation around the inner tray 20 is shown in FIGS. 5 and 6.

Referring to FIG. 2, end walls 51 and 52 are connected to bottom wall 53 by score lines 54 and 55 respectively. Horizontal side flaps 56 and 57 are also connected to bottom wall 53 by score lines 58 and 59 respectively. The end walls 51 and 52 and side flaps 56 and 57 are bent upwardly around the respective score lines and the outer tray 50 is adhered to the inner tray 20 end walls 51 and 52 and bottom wall 53 by glue lines 60 and side flaps 56 and 57 by glue lines 61 and 62.

Outer tray vertical side flaps 63 and 64 connected to end wall 51 by score lines 65 and 66, respectively, and vertical side flaps 67 and 68 connected to end wall 52 by score lines 69 and 70 respectively are bent inwardly and adhered to the inner tray side walls 26 and 37, flaps 63 and 67 by glue line 61 and flaps 64 and 68 by glue line 62. The container is now in the configuration shown in FIG. 6.

Closing the container, after it is filled with a product is shown in FIGS. 7 and 8. This configuration allows closure in the field or in an environment in which no closure machinery is available. Cover panels 39 and 40 of inner tray 20 are bent downwardly over the product and locking tabs 71–74, connected to outer tray vertical side flaps 63–64 and 67–68 by score lines 75–78 respectively, are bent inwardly until they overlie the cover panels 39 and 40. Cover panel locking means. 80 and 81, connected to end panels 51 and 52 by score lines 82 and 83 respectively, are then wrapped around the locking tabs 71, 72, 73 and 74. Each of the cover panel locking means is divided by double score lines into an upper panel that overlies the locking tabs, an edge panel and an underlying panel that fits between the locking tabs and the closure panels. For example panel cover locking means 80 is divided by double score lines 84 and 85 into overlying panel 86, edge panel 87 and underlying panel 88, and cover panel locking means 81 is divided by double score lines 89 and 90 into overlying panel 91, edge panel 92 and underlying panel 93.

Hand holes 95 and 96 are provided in panels 80 and 81 to allow easy opening of the container.

Vent holes may be provided in the side and cover panels of the container to allow cooling of the contents. Lower side edge vent holes 100 in side walls 36 and 37 are aligned with vent holes 101 in the side wall panels 26, 27, 30 and 31, and with the vent holes 102 in the side flaps 56 and 57. Center vent holes 103 in the inner tray side walls 36 and 37 are aligned with the center vent holes 104 in the side wall panels 26, 27, 30 and 31, and upper vent holes 105 in the inner tray side walls 36 and 37 are aligned with the vent holes 106 in the side wall panels. The middle and upper vent holes are within the borders defined by side flaps 56, 63 and 67, and 57, 64 and 68. There are additional vent holes 107 in the cover panels 39 and 40. These are between the borders defined by the locking panels.

Figure 9:
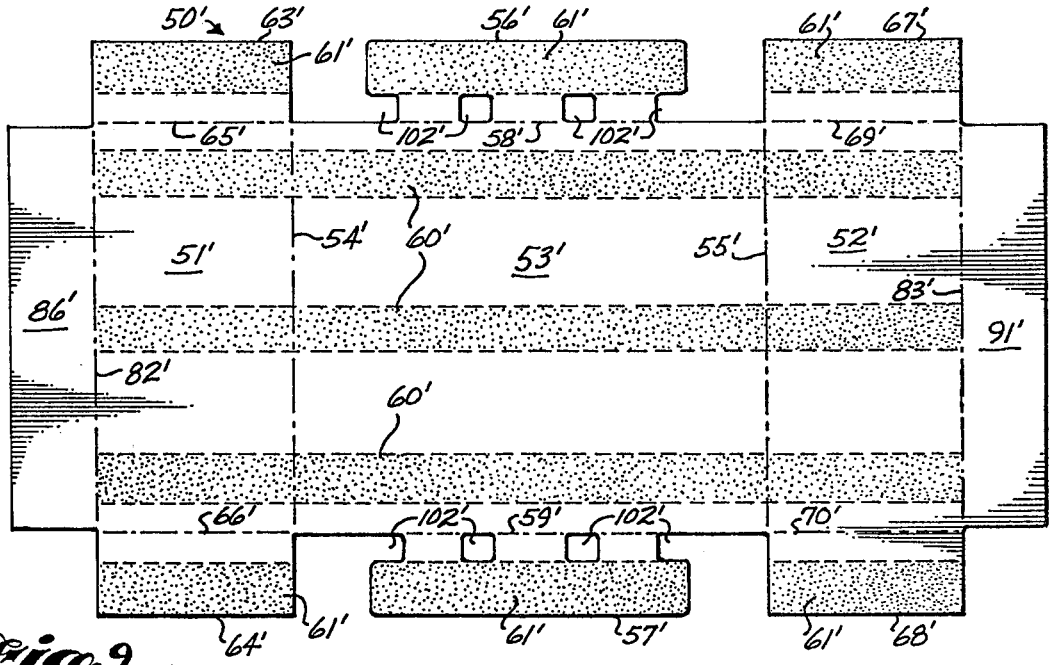
FIG. 9 is a top plan view of a blank of a modified outer container which may be machine closed in the factory.
Figure 10:
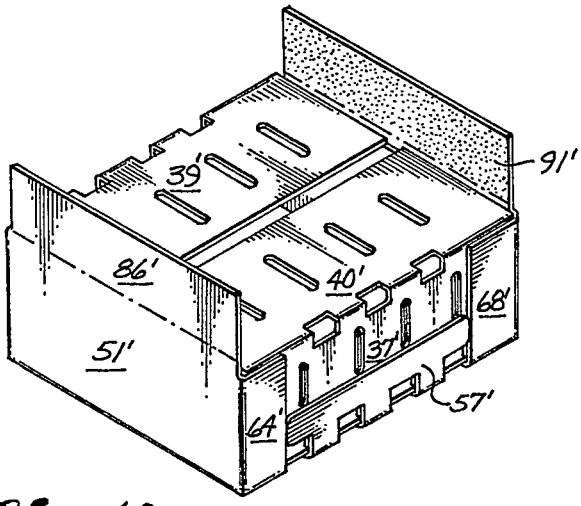
FIGs. 10–11 are isometric views showing the closure of the modified container.
Figure 11:
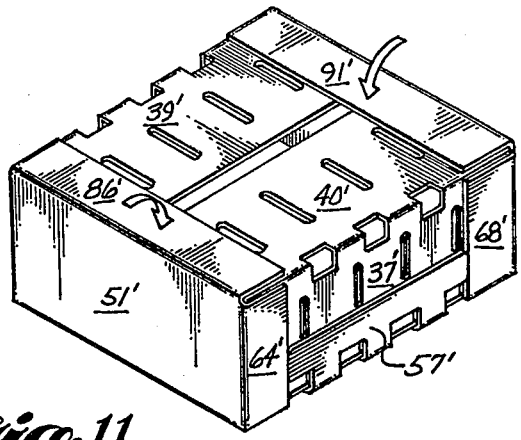

FIGS. 9–11 shows a modification of the basic box. Instead of the wraparound locking panels on the upper cover, there is only the cover panel locking means 86' and 91' which are glued to the cover panels 39' and 40'. All of the other elements of the container are the same and like reference numerals are used.

What is claimed is:

1. A container comprising:

an inner tray comprising bottom, side and end walls;

an outer tray comprising bottom and end walls contiguous with the bottom and end walls of said inner tray, and side flaps attached to said inner tray side walls;

a cover panel attached to one of said trays; and cover panel locking means attached to one of said trays.

2. The container of claim 1 in which said outer tray side flaps comprise:

vertical side flaps hingedly attached to said outer tray end walls, and horizontal side flaps hingedly attached to said outer tray bottom wall.

3. The container of claim 1 in which said outer tray bottom and end walls are attached to said inner tray.

4. The container of claim 1 in which said inner tray side and end walls are hingedly attached to said bottom wall; and side wall panels are hingedly attached to said inner tray end walls and contiguous with said inner tray side walls to provide at least a double wall construction throughout said side walls.

5. The container of claim 4 in which said inner tray side wall panels are attached to said inner tray side walls.

6. The container of claim 1 in which said cover panel locking means is attached to the other of said trays.

7. The container of claim 6 in which said outer tray side flaps comprise:

vertical side flaps hingedly attached to said outer tray end walls, and horizontal side flaps hingedly attached to said outer tray bottom wall.

8. The container of claim 6 in which said outer tray bottom and end walls are attached to said inner tray.

9. The container of claim 6 in which said outer tray vertical side flaps are attached to side edges of said inner tray side walls and the portion of said inner tray side walls between said vertical side flaps is indented below said vertical side flaps; and vent holes defined in said inner tray side walls within the borders defined by said outer tray vertical side flaps.

10. The container of claim 9 in which said cover panel locking means comprises locking panels overlying opposed edges of said cover panel, the portion of said cover panel between said overlying locking panels is indented below said locking panels, and vent holes are in said cover panel within the borders defined by said locking panels.

11. The container of claim 6 in which said inner tray side and end walls are hingedly attached to said inner tray bottom wall; and inner tray side wall panels are hingedly attached to said inner tray end walls and contiguous with said inner tray side walls to provide at least a double wall construction throughout said side walls.

12. The container of claim 11 in which said inner tray side wall panels are attached to said inner tray side walls.

13. The container of claim 11 in which said cover panel locking means comprises locking panels overlying opposed edges of said cover panels;

the portion of said cover panel between said overlying locking panels is indented below said locking panels;

vent holes defined in said cover penel within the border defined by said locking panel;

said outer tray vertical side flaps are attached to side edges of said inner tray side walls and the portion of said inner tray side walls between said side flaps is indented below said side flaps; and vent holes are defined in said side walls within the borders defined by said outer tray vertical side flaps.

14. The container of claim 6 in which said outer tray side flaps comprise vertical side flaps hingedly attached to said outer tray end walls; and said cover locking means comprises:

locking tabs hingedly attached to said vertical side flaps and overlying said cover panel; and locking panels hingedly attached to said end walls, each comprising:

a first panel overlying said locking tab;

a second panel coextensive with an edge of said locking tab; and a third panel extending between said locking tab and said cover panel.

15. A blank for a tray comprising:

a bottom wall;

end panels hingedly attached to opposed sides of said bottom wall;

cover panel locking means hingedly attached to each of said end panels along the side opposite said bottom wall;

each of said cover panel locking means being divided by score lines into a first upper panel adjacent said end panel, a second underlying panel on the outer edge of said locking panel, and an intermediate edge panel between said first upper and second underlying panels;

vertical side flaps hingedly attached to the other opposed sides of said end panels; and locking tabs hingedly attached to said vertical side flaps along the edge adjacent said locking panels.

16. The blank of claim 15 further comprising:

horizontal side flaps hingedly attached to the other opposed sides of said bottom wall.

* * * * *

UNITED STATES PATENT AND TRADEMARK OFFICE

CERTIFICATE OF CORRECTION

PATENT NO. : 4,103,819

DATED : August 1, 1978

INVENTOR(S) : HERBERT D. MUISE

It is certified that error appears in the above-identified patent and that said Letters Patent are hereby corrected as shown below:

In column 2, line 35, "26" should read --36--;

in column 2, line 54, "example panel cover" should read --example, cover panel--; and in column 3, line 9, "shows" should read --show--.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*